US012636540B1

(12) United States Patent
Burge

(10) Patent No.: US 12,636,540 B1
(45) Date of Patent: May 26, 2026

(54) THERAPEUTIC STABILIZATION DEVICES AND METHODS OF ASSEMBLING AND USING THE SAME

(71) Applicant: Camden Tovar Burge, Greenville, NC (US)

(72) Inventor: Camden Tovar Burge, Greenville, NC (US)

( * ) Notice: Subject to any disclaimer, the term of this patent is extended or adjusted under 35 U.S.C. 154(b) by 144 days.

(21) Appl. No.: 18/444,864

(22) Filed: Feb. 19, 2024

Related U.S. Application Data

(63) Continuation-in-part of application No. 17/809,594, filed on Jun. 29, 2022, now Pat. No. 11,925,830.

(60) Provisional application No. 63/217,940, filed on Jul. 2, 2021.

(51) Int. Cl.
*A63B 21/00* (2006.01)
*A63B 23/035* (2006.01)
*A63B 23/04* (2006.01)

(52) U.S. Cl.
CPC .... *A63B 21/4015* (2015.10); *A63B 21/00047* (2013.01); *A63B 21/4039* (2015.10); *A63B 23/03508* (2013.01); *A63B 23/04* (2013.01); *A63B 23/0405* (2013.01); *A63B 2208/0204* (2013.01)

(58) Field of Classification Search
CPC ..... A63B 21/4015; A63B 21/00047; A63B 21/4039; A63B 23/03508; A63B 23/04; A63B 23/0405; A63B 2208/0204
See application file for complete search history.

(56) References Cited

U.S. PATENT DOCUMENTS

| | | | | |
|---|---|---|---|---|
| 2,966,905 | A | 1/1961 | Kamenshine | |
| 3,787,048 | A | 1/1974 | Bock | |
| 5,263,919 | A * | 11/1993 | Hollenback | A63B 21/00047 482/145 |
| 6,022,298 | A | 2/2000 | Svedarsky et al. | |
| 6,656,055 | B1 | 12/2003 | Marro | |
| 7,841,973 | B2 | 11/2010 | Trancart et al. | |
| 9,370,688 | B1 | 6/2016 | Pannozzo | |
| 9,687,693 | B2 * | 6/2017 | Archer | A63B 69/0062 |

(Continued)

OTHER PUBLICATIONS

USPTO, Non-final Office Action for corresponding U.S. Appl. No. 17/809,594, mailed Sep. 27, 2023, 16 pages.

*Primary Examiner* — Loan B Jimenez
*Assistant Examiner* — Kathleen M Fisk
(74) *Attorney, Agent, or Firm* — NK Patent Law

(57) ABSTRACT

A device is disclosed for facilitating a therapeutic exercise of a user. The device includes a stabilizing bracket. The stabilizing bracket includes a horizontal member, a fixed position left side vertical member mechanically coupled at a left end of the horizontal member, a fixed position right side vertical member mechanically coupled at a right end of the horizontal member, and a user adjustable vertical member configured to be mechanically coupled in a plurality of horizontal member locations between the fixed position left side vertical member and the fixed position right side vertical member. The device further includes an upper rigid member configured to be mechanically coupled with the user adjustable vertical member and further configured for contacting a right knee of the user; and a lower rigid member configured to be mechanically coupled with the user adjustable vertical member and further configured for contacting a right instep of the user.

17 Claims, 14 Drawing Sheets

(56) References Cited

U.S. PATENT DOCUMENTS

| | | | | |
|---|---|---|---|---|
| 10,118,069 | B2 | 11/2018 | Grossman et al. | |
| 10,434,352 | B2 | 10/2019 | Campbell | |
| 10,456,620 | B1 | 10/2019 | Duenas | |
| 10,486,020 | B2 | 11/2019 | Sadikaj | |
| 11,077,338 | B1 | 8/2021 | Levin et al. | |
| 2007/0072745 | A1 | 3/2007 | Nicholas | |
| 2022/0203161 | A1 | 6/2022 | Duenas | |
| 2024/0165458 | A1* | 5/2024 | Nesbit ..... | A63B 21/4034 |

* cited by examiner

THERAPEUTIC STABILIZATION DEVICES AND METHODS OF ASSEMBLING AND USING THE SAME

PRIORITY CLAIM

This application is a continuation-in-part application of U.S. patent application Ser. No. 17/809,594 filed Jun. 29, 2022, titled "THERAPEUTIC STABILIZATION DEVICES AND METHODS OF ASSEMBLING AND USING THE SAME", which claims priority to U.S. Provisional Patent Application Ser. No. 63/217,940 filed Jul. 2, 2021, titled "THERAPEUTIC STABILIZATION DEVICES AND METHODS OF ASSEMBLING AND USING THE SAME", the disclosures of all of which are incorporated herein by reference in their entireties.

TECHNICAL FIELD

The presently disclosed subject matter relates to a stabilization device for therapeutic exercise.

BACKGROUND

Squats and lunges are both effective leg exercises. Squats can target the calf, hamstring, inner thigh, gluteus maximus, and quadriceps muscles. Additionally, squats can be easier to perform correctly than lunges. However, lunges can better target each of these muscle groups. When performing lunges, an individual may easily be prone to using bad form. The individual may extend their knees past their toes reducing the effectiveness of the lunge. If the knees wobble there may be extra stress applied at the hip joints, knees, and/or ankles. Finally, if the core muscles are not contracted during the lunge, lower back injury becomes a possibility.

As such, new devices and methods are needed to better support individuals when beginning lunges after long inactivity and/or recovering from injuries.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Disclosed herein are devices and methods for therapeutic exercise. In one embodiment a device is disclosed for facilitating a therapeutic exercise of a user. The device includes an upper rigid member configured for contacting a right knee of the user, a lower rigid member configured for contacting a right instep of the user, a vertical brace, a first mechanical coupling configured for attaching the upper rigid member to the vertical brace, and a second mechanical coupling configured for attaching the lower rigid member to the vertical brace.

In some embodiments, the device may further include a first spacer. The first spacer may be configured to be positioned in a first arrangement of the device between the upper rigid member and the vertical brace using the first mechanical coupling. The first spacer may be further configured to be positioned in a second arrangement of the device between the lower rigid member and the vertical brace using the second mechanical coupling. The first arrangement of the device may be configured to provide a first stabilizing position of a right tibia of the user relative to the right instep of the user and the second arrangement of the device may be configured to provide a second stabilizing position of the right tibia of the user relative to the right instep of the user. The second stabilizing position may position the right knee more forward relative to the right instep versus the first stabilizing position.

In further embodiments, the device may include a second spacer. The first spacer and the second spacer may be configured to be positioned in a third arrangement of the device between the upper rigid member and the vertical brace using the first mechanical coupling. Additionally, the first spacer and the second spacer may be further configured to be positioned in a fourth arrangement of the device between the lower rigid member and the vertical brace using the second mechanical coupling. In further embodiments, the first spacer and the second spacer may be interchangeable with each other.

In still further embodiments, the device may include a third spacer. The first spacer, the second spacer, and the third spacer may be configured to be positioned in a fifth arrangement of the device between the upper rigid member and the vertical brace using the first mechanical coupling. Additionally, the first spacer, the second spacer, and the third spacer may be further configured to be positioned in a sixth arrangement of the device between the lower rigid member and the vertical brace using the second mechanical coupling. The first spacer, the second spacer, and the third spacer may be interchangeable with each other.

In some embodiments the device may include a first strap configured for securing the right knee of the user against the upper rigid member. In further embodiments the device may include a second strap configured for securing the right instep of the user against the lower rigid member.

In some embodiments, the upper rigid member may be configured to be semi-circumferential around the right knee of the user and the lower rigid member may be configured to be semi-circumferential around the right instep of the user.

In some embodiments, the upper rigid member may be configured for contacting a left knee of the user and the lower rigid member may be configured for contacting a left instep of the user. In further embodiments, the upper rigid member may be further configured to be semi-circumferential around the left knee of the user and the lower rigid member may be further configured to be semi-circumferential around the left instep of the user.

In some embodiments, the first mechanical coupling may be further configured to allow the upper rigid member to be positioned in a plurality of locations along the vertical brace.

In some embodiments, the therapeutic exercise may be a lunge exercise. In further embodiments, the therapeutic exercise may be a backward lunge exercise.

In some embodiments, the device may further include a horizontal brace, and a third mechanical coupling configured for attaching the horizontal brace to the vertical brace. In further embodiments, the device may include a support frame, a fourth mechanical coupling configured for attaching a left section of the horizontal brace to the support frame, and a fifth mechanical coupling configured for attaching a right section of the horizontal brace to the support frame.

In another embodiment, a method of performing a therapeutic exercise using a device is disclosed. The method includes positioning a right knee of a user against an upper rigid member of the device and positioning a right instep of the user against a lower rigid member of the device. The upper rigid member is attached to a vertical brace using a first mechanical coupling and the lower rigid member is attached to the vertical brace using a second mechanical coupling.

In some embodiments, the method may include positioning a first spacer in a first arrangement of the device between the upper rigid member and the vertical brace using the first mechanical coupling. The method may also include positioning the first spacer in a second arrangement of the device between the lower rigid member and the vertical brace using the second mechanical coupling. The first arrangement of the device may be configured to provide a first stabilizing position of a right tibia of the user relative to the right instep of the user and the second arrangement of the device may be configured to provide a second stabilizing position of the right tibia of the user relative to the right instep of the user. The second stabilizing position may position the right knee more forward relative to the right instep versus the first stabilizing position.

In further embodiments, the method may include positioning the first spacer and a second spacer in a third arrangement of the device between the upper rigid member and the vertical brace using the first mechanical coupling. The method may also include positioning the first spacer and the second spacer in a fourth arrangement of the device between the lower rigid member and the vertical brace using the second mechanical coupling. Additionally, the first spacer and the second spacer may be interchangeable with each other.

In still further embodiments, the method may include positioning the first spacer, the second spacer, and a third spacer in a fifth arrangement of the device between the upper rigid member and the vertical brace using the first mechanical coupling. Additionally, the method may include positioning the first spacer, the second spacer, and the third spacer in a sixth arrangement of the device between the lower rigid member and the vertical brace using the second mechanical coupling. The first spacer, the second spacer, and the third spacer may be interchangeable with each other.

In some embodiments the method may include securing the right knee of the user against the upper rigid member using a first strap. Additionally, the method may include securing the right instep of the user against the lower rigid member using a second strap.

In some embodiments, the method further includes instructing the user to perform the therapeutic exercise. In other embodiments, the method includes performing the therapeutic exercise by the user.

In some embodiments, the method may further include positioning the upper rigid member in a plurality of locations along the vertical brace using the first mechanical coupling.

In some embodiments, the upper rigid member may be further configured to be semi-circumferential around the right knee of the user and the lower rigid member may be further configured to be semi-circumferential around the right instep of the user.

In some embodiments, the method may further include positioning a left knee of the user against the upper rigid member of the device and positioning a left instep of the user against the lower rigid member of the device. In further embodiments, the upper rigid member may be further configured to be semi-circumferential around the left knee of the user and the lower rigid member may be further configured to be semi-circumferential around the left instep of the user.

In some embodiments, the therapeutic exercise may be a lunge exercise. In further embodiments, the therapeutic exercise may be a backward lunge exercise.

In another embodiment, a method of assembling a device for facilitating a therapeutic exercise of a user is disclosed. The method includes connecting an upper rigid member to a vertical brace using a first mechanical coupling and connecting a lower rigid member to the vertical brace using a first mechanical coupling. The upper rigid member is configured for contacting a right knee of the user and the lower rigid member is configured for contacting a right instep of the user.

In some embodiments, the method may include positioning a first spacer in a first arrangement of the device between the upper rigid member and the vertical brace using the first mechanical coupling. The method may also include positioning the first spacer in a second arrangement of the device between the lower rigid member and the vertical brace using the second mechanical coupling. The first arrangement of the device may be configured to provide a first stabilizing position of a right tibia of the user relative to the right instep of the user and the second arrangement of the device may be configured to provide a second stabilizing position of the right tibia of the user relative to the right instep of the user. The second stabilizing position may position the right knee more forward relative to the right instep versus the first stabilizing position.

In further embodiments, the method may include positioning the first spacer and a second spacer in a third arrangement of the device between the upper rigid member and the vertical brace using the first mechanical coupling. The method may also include positioning the first spacer and the second spacer in a fourth arrangement of the device between the lower rigid member and the vertical brace using the second mechanical coupling. Additionally, the first spacer and the second spacer may be interchangeable with each other.

In still further embodiments, the method may include positioning the first spacer, the second spacer, and a third spacer in a fifth arrangement of the device between the upper rigid member and the vertical brace using the first mechanical coupling. Additionally, the method may include positioning the first spacer, the second spacer, and the third spacer in a sixth arrangement of the device between the lower rigid member and the vertical brace using the second mechanical coupling. The first spacer, the second spacer, and the third spacer may be interchangeable with each other.

In some embodiments the method may include connecting a first strap to the upper rigid member. Additionally, the method may include connecting a second strap to the lower rigid member. The first strap may be configured for securing the right knee of the user against the upper rigid member. The second strap may be configured for securing the right instep of the user against the lower rigid member.

In some embodiments, the upper rigid member may be further configured to be semi-circumferential around the right knee of the user and the lower rigid member may be further configured to be semi-circumferential around the right instep of the user.

In some embodiments, the upper rigid member may be configured for contacting a left knee of the user and the lower rigid member may be configured for contacting a left instep of the user. In further embodiments, the upper rigid member may be further configured to be semi-circumferential around the left knee of the user and the lower rigid member may be further configured to be semi-circumferential around the left instep of the user.

In some embodiments, the first mechanical coupling may be further configured to allow the upper rigid member to be positioned in a plurality of locations along the vertical brace.

In some embodiments, the therapeutic exercise may be a lunge exercise. In further embodiments, the therapeutic exercise may be a backward lunge exercise.

In another embodiment a device is disclosed for facilitating a therapeutic exercise of a user. The device includes a stabilizing bracket. The stabilizing bracket includes a horizontal member, a fixed position left side vertical member mechanically coupled at a left end of the horizontal member, a fixed position right side vertical member mechanically coupled at a right end of the horizontal member, and a user adjustable vertical member configured to be mechanically coupled in a plurality of horizontal member locations between the fixed position left side vertical member and the fixed position right side vertical member. The device further includes an upper rigid member configured to be mechanically coupled with the user adjustable vertical member and further configured for contacting a right knee of the user. Additionally, the device further includes a lower rigid member configured to be mechanically coupled with the user adjustable vertical member and further configured for contacting a right instep of the user.

In some embodiments, the device may further include a user adjustable upper mechanical coupling configured to be positioned between the upper rigid member and the user adjustable vertical member and further configured for providing a plurality of knee height positions for the upper rigid member.

In some embodiments, the lower rigid member comprises a user adjustable lower mechanical coupling configured to mechanically couple with the user adjustable vertical member and further configured for providing a plurality of instep height positions for the lower rigid member.

In some embodiments, the device may further include a right side stabilizing leg configured to be mechanically coupled with the stabilizing bracket and further configured for contacting a horizontal surface and a left side stabilizing leg configured to be mechanically coupled with the stabilizing bracket and further configured for contacting the horizontal surface.

In some embodiments, the fixed position left side vertical member may be configured for contacting the horizontal surface and the fixed position right side vertical member may be configured for contacting the horizontal surface.

In some embodiments, the upper rigid member may be configured to be user positioned in a plurality of horizontal locations relative to the lower rigid member.

In some embodiments, the horizontal member may include a plurality of horizontal member holes. In further embodiments, the user adjustable vertical member may be further configured to be mechanically coupled in the plurality of horizontal member locations between the fixed position left side vertical member and the fixed position right side vertical member using the plurality of horizontal member holes.

In some embodiments, the user adjustable upper mechanical coupling may include a plurality of upper coupling holes. In further embodiments, the user adjustable upper mechanical coupling may be further configured for providing the plurality of knee height positions for the upper rigid member using the plurality of upper coupling holes.

In some embodiments, the user adjustable lower mechanical coupling may include a plurality of lower coupling holes. In further embodiments, the user adjustable lower mechanical coupling may be further configured for providing the plurality of instep height positions for the lower rigid member using the plurality of lower coupling holes.

In some embodiments, the upper rigid member may include a plurality of upper rigid member holes. In further embodiments, the upper rigid member may be further configured to be user positioned in a plurality of horizontal knee locations relative to the lower rigid member using the plurality of upper rigid member holes.

In some embodiments, the device may further include a first locking pin configured for securing the user adjustable vertical member in the plurality of horizontal member locations between the fixed position left side vertical member and the fixed position right side vertical member using the plurality of horizontal member holes.

In some embodiments, the device may further include a second locking pin configured for securing the user adjustable upper mechanical coupling in the plurality of knee height positions for the upper rigid member using the plurality of upper coupling holes.

In some embodiments, the device may further include a third locking pin configured for securing the user adjustable lower mechanical coupling in the plurality of instep height positions for the lower rigid member using the plurality of lower coupling holes; and In some embodiments, the device may further include a fourth locking pin configured for securing the upper rigid member in the plurality of horizontal knee locations relative to the lower rigid member using the plurality of upper rigid member holes.

In some embodiments, the device may further include a first strap configured for securing the right knee of the user against the upper rigid member.

In some embodiments, the device may further include a second strap configured for securing the right instep of the user against the lower rigid member.

In some embodiments, the upper rigid member may be further configured to be semi-circumferential around the right knee of the user.

In some embodiments, the lower rigid member may be further configured to be semi-circumferential around the right instep of the user.

In some embodiments, the upper rigid member may be further configured for contacting a left knee of the user and the lower rigid member may be further configured for contacting a left instep of the user.

In some embodiments, the therapeutic exercise may be a lunge exercise. In further embodiments, the therapeutic exercise may be a backward lunge exercise.

In another embodiment, a method of performing a therapeutic exercise using a device is disclosed. The method includes positioning a right knee of a user against an upper rigid member and positioning a right instep of the user against a lower rigid member. The device includes a stabilizing bracket. The stabilizing bracket includes a horizontal member, a fixed position left side vertical member mechanically coupled at a left end of the horizontal member, a fixed position right side vertical member mechanically coupled at a right end of the horizontal member, and a user adjustable vertical member configured to be mechanically coupled in a plurality of horizontal member locations between the fixed position left side vertical member and the fixed position right side vertical member. The device further includes the upper rigid member configured to be mechanically coupled with the user adjustable vertical member. Additionally, the device further includes the lower rigid member configured to be mechanically coupled with the user adjustable vertical member.

In some embodiments, the method may further include instructing the user to perform the therapeutic exercise. In other embodiments, the method may further include performing the therapeutic exercise by the user.

In some embodiments, the therapeutic exercise may be a lunge exercise. In further embodiments, the therapeutic exercise may be a backward lunge exercise.

In another embodiment, a method of assembling a device for facilitating a therapeutic exercise of a user is disclosed. The method includes connecting an upper rigid member to a user adjustable vertical member of a stabilizing bracket using an upper mechanical coupling and connecting a lower rigid member to the user adjustable vertical member of the stabilizing bracket using a lower mechanical coupling. The upper rigid member is configured for contacting a right knee of the user and the lower rigid member is configured for contacting a right instep of the user.

In some embodiments, the upper rigid member may be further configured for contacting a left knee of the user and the lower rigid member may be further configured for contacting a left instep of the user. As such, the therapeutic exercise may be performed by the user with the right knee and the right instep stabilized by the device or the left knee and left instep stabilized by the device.

In some embodiments, the therapeutic exercise may be a lunge exercise. In further embodiments, the therapeutic exercise may be a backward lunge exercise.

BRIEF DESCRIPTION OF THE DRAWINGS

The present embodiments are illustrated by way of example and are not intended to be limited by the figures of the accompanying drawings. In the drawings.

DETAILED DESCRIPTION

Figure 1:
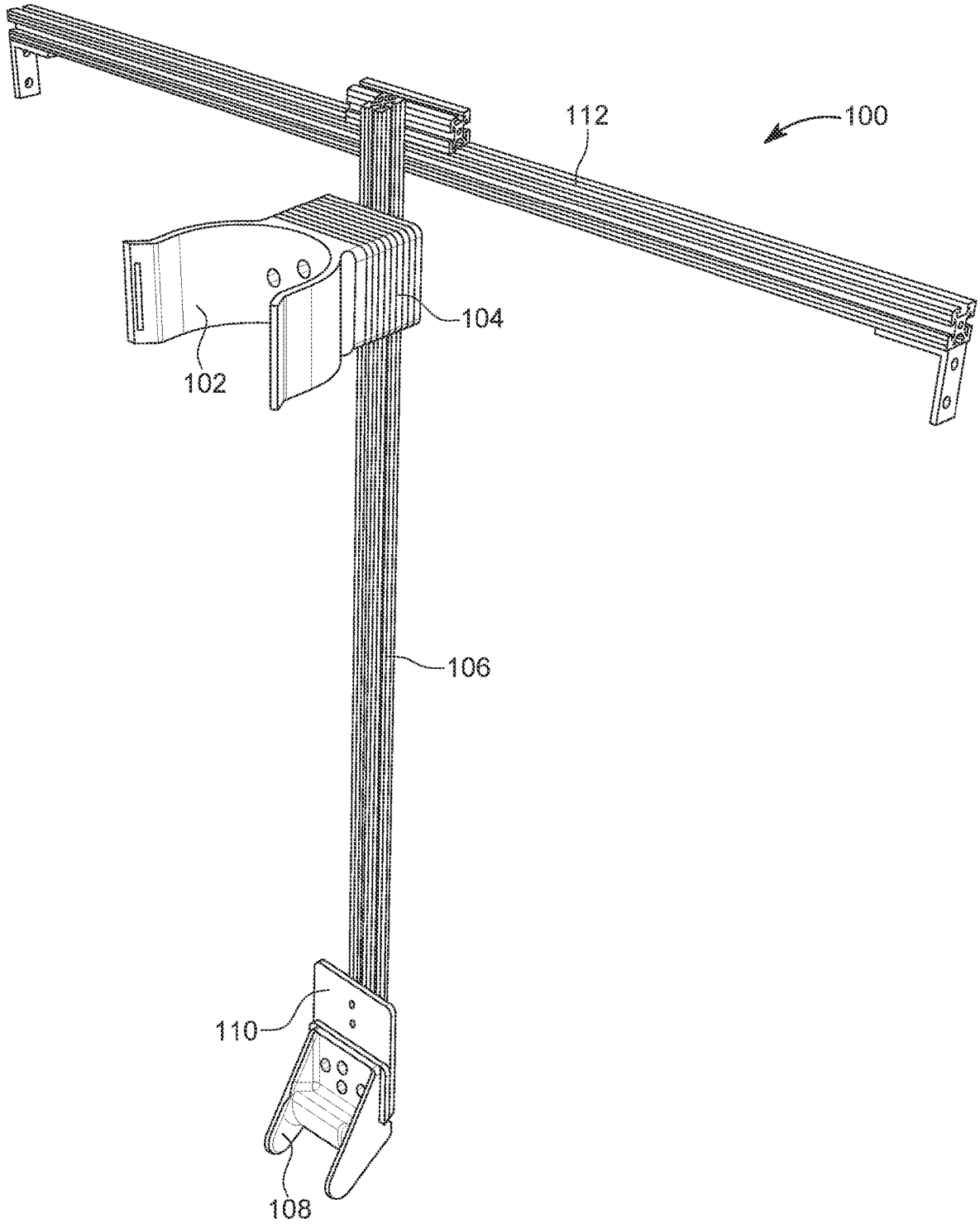
FIG. 1 depicts a diagram illustrating a first embodiment of a therapeutic stabilization device in accordance with embodiments of the present disclosure.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed devices and methods.

Disclosed herein are devices and methods for therapeutic exercise. If an individual has been inactive and/or recovering from an injury prior to starting a new exercise routine, the muscles needed to keep good form may be weak and/or atrophied. Of specific concern are lunging exercises. These exercises when performed incorrectly may cause back, knee, and/or ankle injuries. Additionally, an individual may experience pain when performing such exercises. With this pain comes fear and a locked mentality in stepping forward to rehabilitate. This can be especially true if the rehabilitation exercises require motions that once caused injury. Additionally, years of inactivity for ankles, knees, and hips will oppose any movement counter to the individual's evolved and/or established normal. Elasticity and mobility are lost if the muscles are not targeted and worked through, ripped and rebuilt through aerobic and strength training activity.

As such, new devices and methods are needed to better facilitate individuals when beginning such an exercise routine. These devices and methods would be most useful in rehabilitation facilities, workout centers, physical therapy centers, university athletic centers, and even online subscription programs performed at the individual's home.

FIG. 1 depicts a diagram illustrating a therapeutic stabilization device 100 for facilitating a therapeutic exercise of a user in accordance with embodiments of the present disclosure. The therapeutic stabilization device 100 includes an upper rigid member 102, a plurality of upper spacers 104, a vertical brace 106, a lower rigid member 108, a lower spacer 110, and a horizontal brace 112. The upper rigid member 102 is configured for contacting a right knee or a left knee of the user. The lower rigid member 108 is configured for contacting a right instep or a left instep of the user. A first set of bolts and nuts (i.e., a first mechanical coupling) secures the upper rigid member 102 and the plurality of upper spaces 104 to the vertical brace 106. A second set of bolts and nuts (i.e., a second mechanical coupling) secures the lower rigid member 108 and the lower spacer 110 to the vertical brace 106. One or more of the plurality of upper spacers 104 may be repositioned to form a plurality of lower spacers. As such, the position of the user's knee is moved forward relative to the user's instep. Additionally, the upper rigid member 102 may be adjusted to multiple locations on the vertical brace 106 dependent on a size and/or height of the user.

Figure 2:
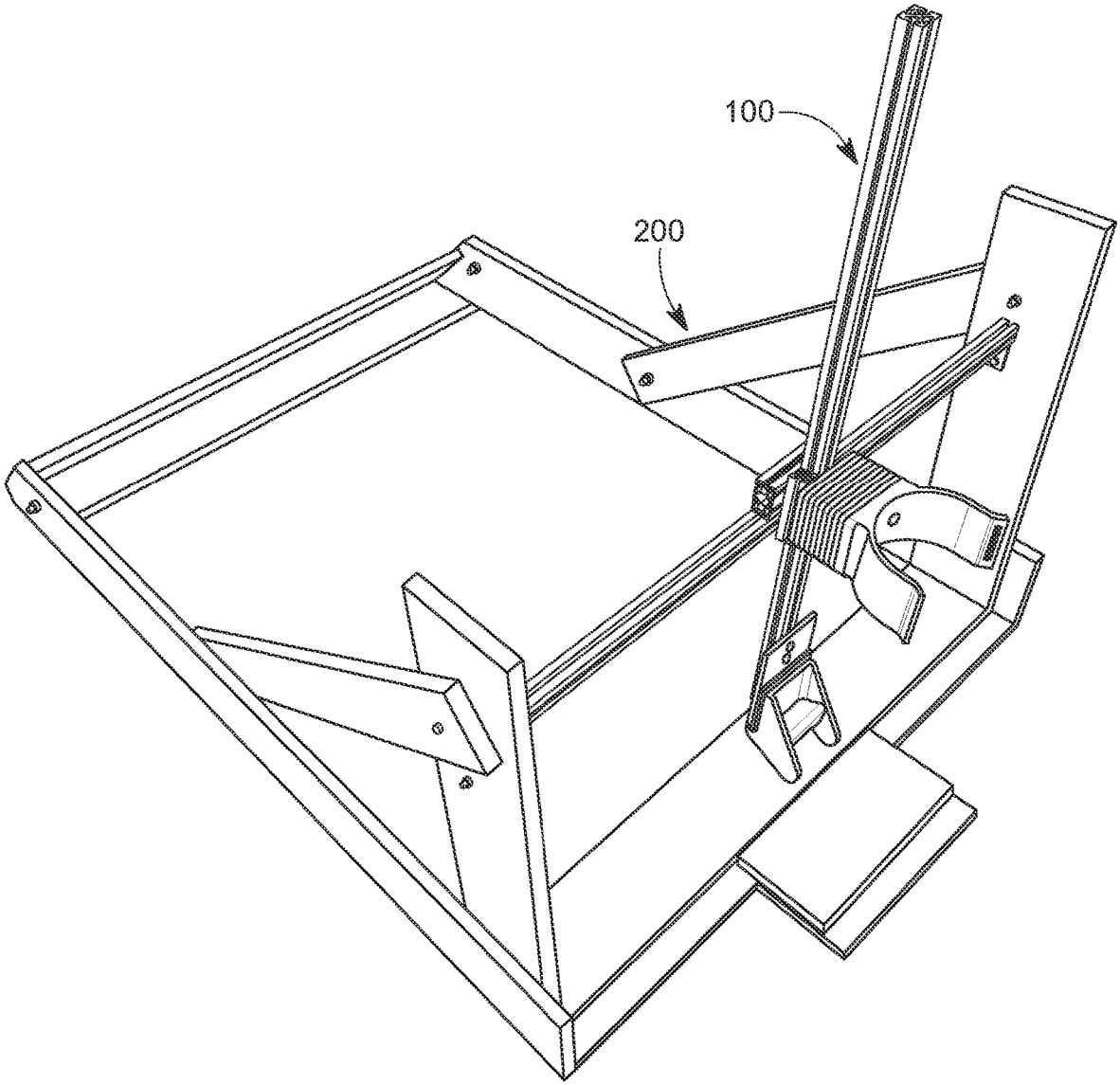
FIG. 2 depicts a diagram illustrating the therapeutic stabilization device of FIG. 1 positioned within a frame in accordance with embodiments of the present disclosure.

FIG. 2 depicts a diagram illustrating the therapeutic stabilization device 100 of FIG. 1 positioned within a frame 200 in accordance with embodiments of the present disclosure. The horizontal brace 112 is secured to a left upright and a right upright of the frame 200 using additional bolts and nuts. The frame 200 includes an extended platform allowing the user to position a foot on the frame 200 to help prevent the frame 200 from sliding. The lower rigid member 108 is positioned to secure an instep of the foot simultaneously while the foot is positioned on the extended platform Additionally, the frame 200 may include non-skid material to further prevent sliding. The frame 200 may be made out of any suitable material. For example, the frame 200 may include wood, plastic, aluminum, steel, and/or the like.

FIGS. 3 through 6 depict four diagrams illustrating a user 300 in four different positions performing a backward lunge exercise using the therapeutic stabilization device 100 mounted in the frame 200 in accordance with embodiments of the present disclosure.

In step one, the user 300 positions their right leg within the upper rigid member 102 (i.e., providing an upper knee touch point) with an erect balanced posture. The user 300 further positions their right ankle stabilized within the lower rigid member lower 108 (i.e., providing an ankle touch point) until their right instep (i.e., upper crest of their right foot) is securely braced and stabilized.

Figure 3:
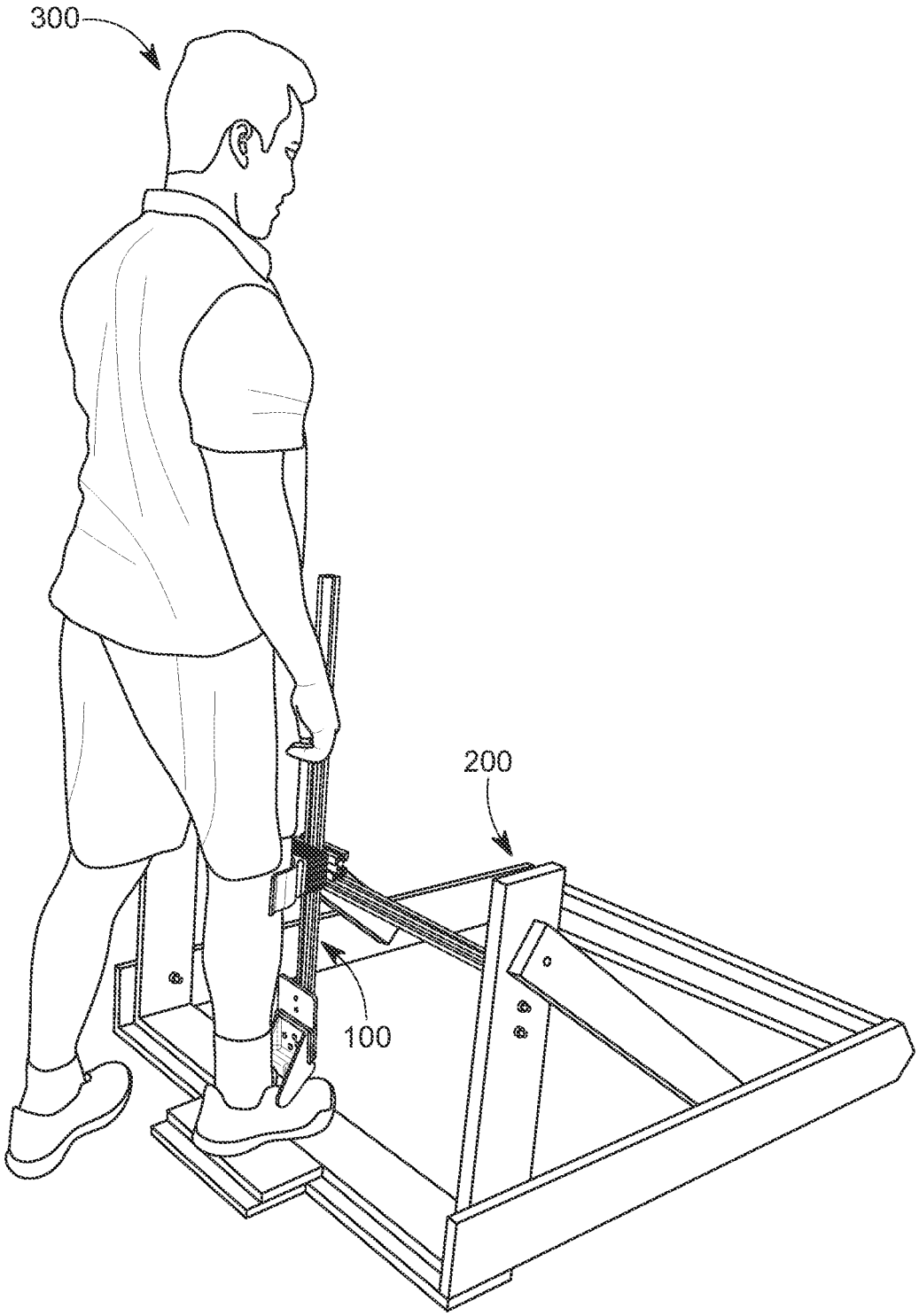
FIG. 3 depicts a diagram illustrating an individual in a first position performing a backward lunge exercise using the therapeutic stabilization device within the frame in accordance with embodiments of the present disclosure.
Figure 4:
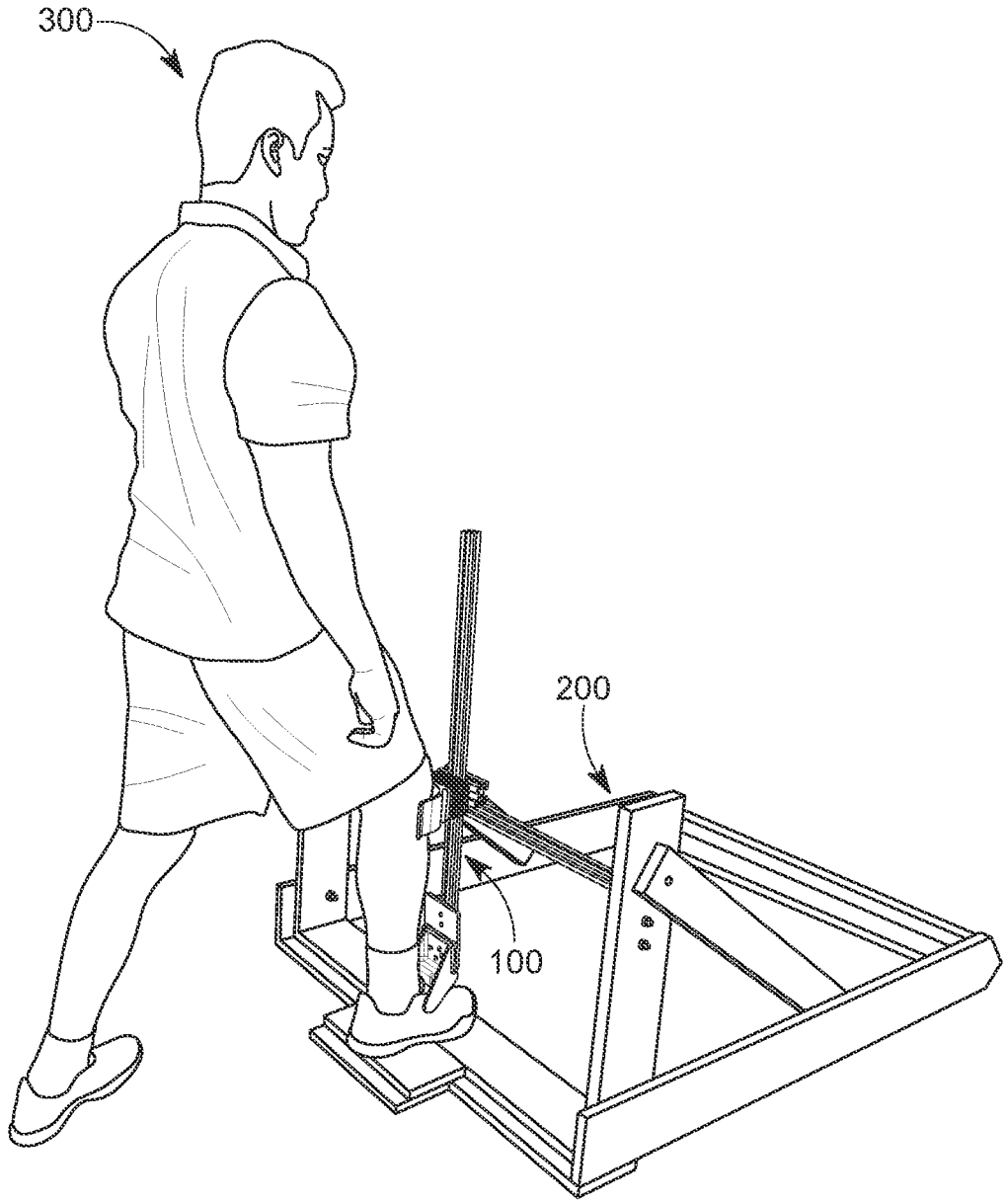
FIG. 4 depicts a diagram further illustrating the individual in a second position performing the backward lunge exercise using the therapeutic stabilization device within the frame in accordance with embodiments of the present disclosure.
Figure 5:
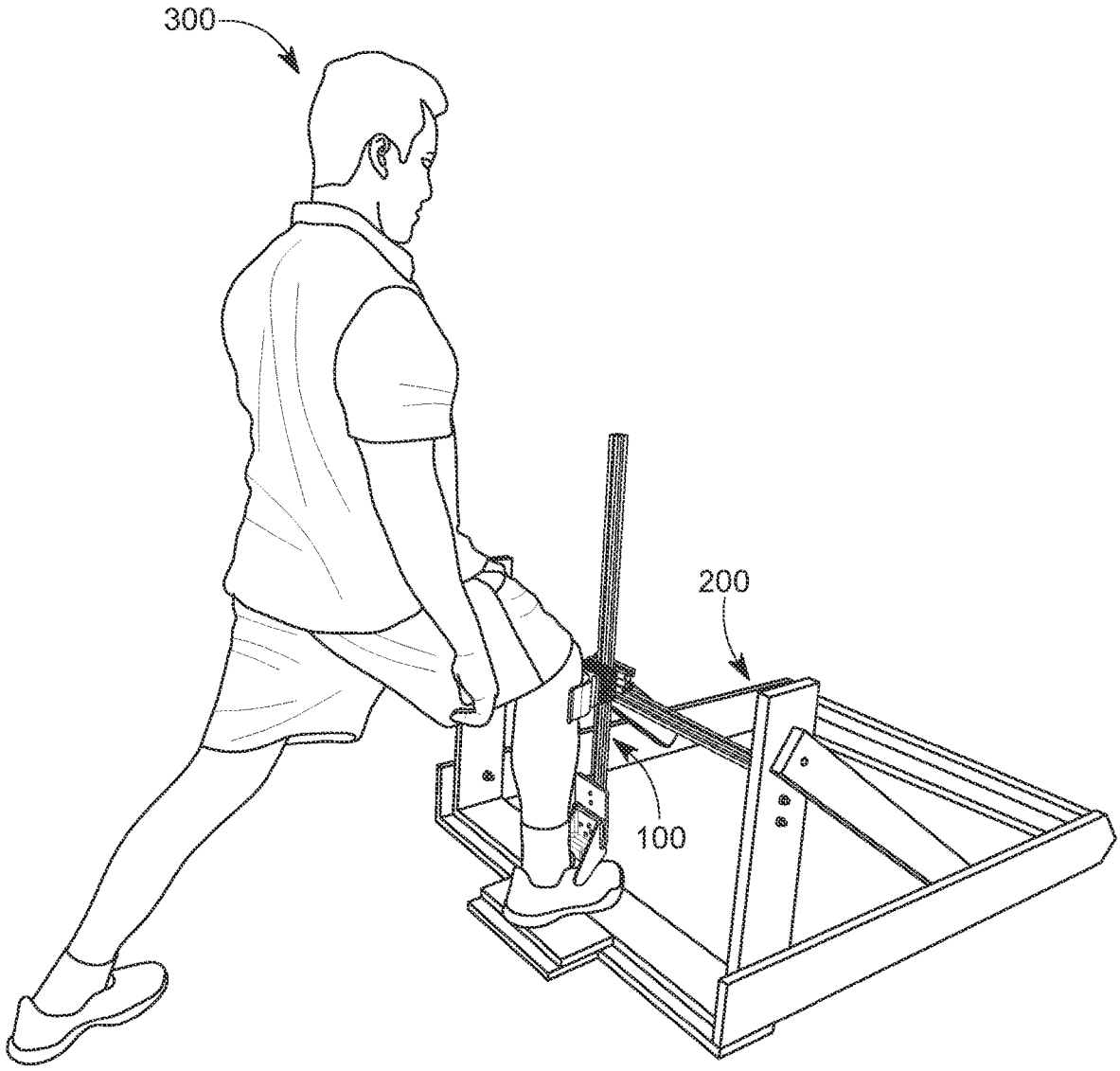
FIG. 5 depicts a diagram further illustrating the individual in a third position performing the backward lunge exercise using the therapeutic stabilization device within the frame in accordance with embodiments of the present disclosure.

In step two, the user 300 stands erect with their left leg (i.e., opposing free leg) slightly staggered as shown in FIG. 3. The user 300 activates their posterior glute muscles, their adductor muscles, their abductor muscles, their quadricep muscles, and their calf muscles ultimately based through their right ankle and left ankle.

In step three and once these muscles are identified and properly activated, the user 300 begins progressing into the backward lunge. The backward lunge is carefully controlled, and the user 300 maintains an erect torso with an approximately equal weight distribution between their right leg and their left leg. This controlled motion is maintained with each muscle activation on each motion and each count.

In step four, the user 300 is in a proper split-lunge position. The left leg (i.e., opposing leg) and the right leg (i.e., secured leg) work in unison with their core stabilizers. The core stabilizers allow for increased control and help to prevent any hip misalignment by the user 300.

In step five and until the user 300 can properly activate the above muscle groups in step one and step four, the distance between the right leg and left leg is kept minimal.

Figure 6:
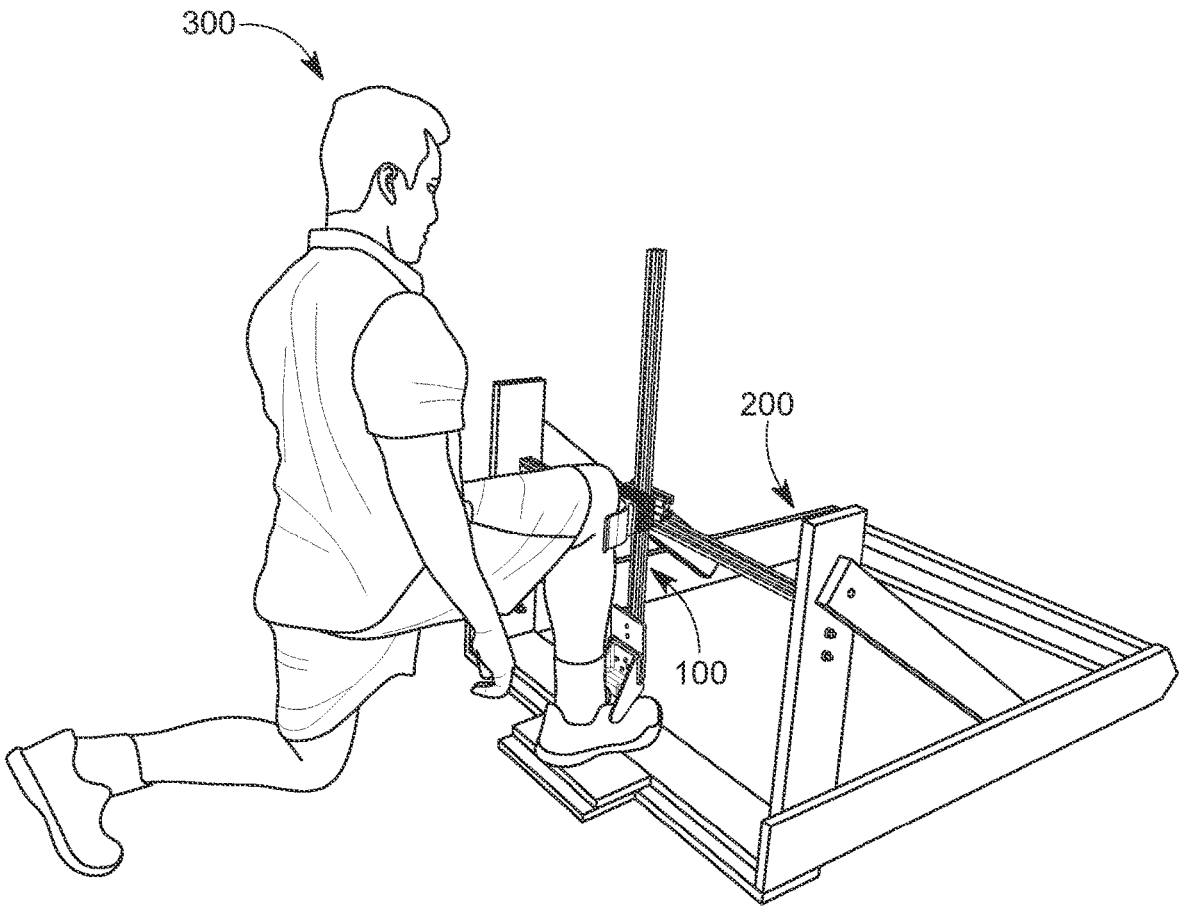
FIG. 6 depicts a diagram further illustrating the individual in a fourth position performing the backward lunge exercise using the therapeutic stabilization device within the frame in accordance with embodiments of the present disclosure.

In step six, the user 300 progresses into a full split-lunge and achieves an approximate ninety-degree angle between their right femoral shaft and their left femoral shaft as shown in FIG. 6. The right knee and right instep stay secured within the therapeutic stabilization device 100, while the left knee makes floor contact. Step six should only be performed once the user 300 has mastered activating the posterior chain muscles, surrounding knee muscles, and ankle stabilizer muscles.

In step seven, the user 300 straightens the left leg and lifts their body upward returning the left leg and the right leg to the original position as indicated in step one. Optionally, the user 300 may maintain the split lunge position with a distance established for comfort. The user 300 may repeat with no deactivation within the above identified muscle groups as disclosed in step two and step four.

A backward lunge is then performed and repeated by the user 300 (and as described above) with their left leg positioned within the upper rigid member 102 with an erect balanced posture and their left ankle stabilized within the lower rigid member lower 108.

In further embodiments (not shown in FIGS. 1 through 6), the frame 200 may be wider and include a mounting arrangement for a second therapeutic stabilization device similar (or identical) to the therapeutic stabilization device 100. The frame 200 may include a second extended platform allowing a second user to position a foot on the frame 200 to help prevent the frame 200 from sliding and allowing the second user to perform a backward lunge with either leg using the second therapeutic stabilization device. The second user may be a coach and/or therapist demonstrating a backward lunge to the first user or simultaneously performing a backward lunge with the first user.

In still further embodiments, the frame 200 may include a second extended platform and may be arranged for a therapeutic stabilization device similar to the therapeutic stabilization device 100 with a wider horizontal brace. The wider horizontal brace allows for a second upper rigid member, a second plurality of upper spacers, a second vertical brace, a second lower rigid member, and a second lower spacer. This arrangement may also allow the second user to perform the backward lunge with either leg using the second upper rigid member, the second lower rigid member, and the second extended platform.

FIG. 7 through FIG. 14 depict eight diagrams illustrating different views of a second embodiment of a therapeutic stabilization device 700 in accordance with embodiments of the present disclosure. The therapeutic stabilization device 700 facilitates a user in performing lunge exercises. The lunge exercises may include backward lunge exercises. The therapeutic stabilization device 700 performs the stabilization to the user in a similar manner to the therapeutic stabilization device 100 of FIG. 3 through FIG. 6.

The therapeutic stabilization device 700 includes an upper rigid member 702, a lower rigid member 704, and a stabilizing bracket 706. The stabilizing bracket 706 includes a horizontal member, a fixed position left side vertical member mechanically coupled at a left end of the horizontal member, a fixed position right side vertical member mechanically coupled at a right end of the horizontal member, and a user adjustable vertical member configured to be mechanically coupled in a plurality of horizontal member locations between the fixed position left side vertical member and the fixed position right side vertical member. The upper rigid member 702 is configured to be mechanically coupled with the user adjustable vertical member and further configured for contacting a right knee of the user. The therapeutic stabilization device 700 further includes a lower rigid member 704. The lower rigid member 704 includes a user adjustable lower mechanical coupling configured to be mechanically coupled with the user adjustable vertical member. The lower rigid member 704 is further configured for contacting a right instep of the user.

The therapeutic stabilization device 700 further includes a user adjustable upper mechanical coupling 708 configured to be positioned between the upper rigid member 702 and the user adjustable vertical member. The user adjustable upper mechanical coupling 708 is further configured for providing a plurality of knee height positions for the upper rigid member 702.

The user adjustable lower mechanical coupling is further configured for providing a plurality of instep height positions for the lower rigid member 704.

The therapeutic stabilization device 700 further includes a right side stabilizing leg 710A configured to be mechanically coupled with the fixed position right side vertical member of the stabilizing bracket 706 and further configured for contacting a horizontal surface (e.g., a floor). The therapeutic stabilization device 700 further includes a left side stabilizing leg 710B configured to be mechanically coupled with the fixed position left side vertical member of the stabilizing bracket 706 and further configured for contacting the horizontal surface. The fixed position left side vertical member is configured for contacting the horizontal surface and the fixed position right side vertical member is configured for contacting the horizontal surface.

The upper rigid member 702 is configured to be user positioned in a plurality of horizontal locations relative to the lower rigid member 704. The horizontal member includes a plurality of horizontal member holes. The user adjustable vertical member is further configured to be mechanically coupled in the plurality of horizontal member locations between the fixed position left side vertical member and the fixed position right side vertical member using the plurality of horizontal member holes.

The user adjustable upper mechanical coupling 708 includes a plurality of upper coupling holes. The user adjustable upper mechanical coupling 708 is further configured for providing the plurality of knee height positions for the upper rigid member 702 using the plurality of upper coupling holes.

The user adjustable lower mechanical coupling includes a plurality of lower coupling holes. The user adjustable lower mechanical coupling is further configured for providing the plurality of instep height positions for the lower rigid member 704 using the plurality of lower coupling holes.

The upper rigid member 702 includes a plurality of upper rigid member holes. The upper rigid member 702 is further configured to be user positioned in a plurality of horizontal knee locations relative to the lower rigid member 704 using the plurality of upper rigid member holes.

The therapeutic stabilization device 700 includes a first locking pin configured for securing the user adjustable vertical member in the plurality of horizontal member locations between the fixed position left side vertical member and the fixed position right side vertical member using the plurality of horizontal member holes.

The therapeutic stabilization device 700 includes a second locking pin configured for securing the user adjustable upper mechanical coupling 708 in the plurality of knee height positions for the upper rigid member 702 using the plurality of upper coupling holes.

The therapeutic stabilization device 700 includes a third locking pin configured for securing the user adjustable lower mechanical coupling in the plurality of instep height positions for the lower rigid member 704 using the plurality of lower coupling holes.

The therapeutic stabilization device 700 includes a fourth locking pin configured for securing the upper rigid member 702 in the plurality of horizontal knee locations relative to the lower rigid member 704 using the plurality of upper rigid member holes.

The therapeutic stabilization device 700 may further include a first strap (not shown in FIG. 7 through FIG. 14). The first strap would be configured for securing the right knee of the user against the upper rigid member 702 as would generally be understood by a person of ordinary skill in the art.

The therapeutic stabilization device 700 may further include a second strap (not shown in FIG. 7 through FIG. 14). The second strap would be configured for securing the right instep of the user against the lower rigid member 704 as would generally be understood by a person of ordinary skill in the art.

The upper rigid member 702 is further configured to be semi-circumferential around the right knee of the user. The lower rigid member 704 is also configured to be semi-circumferential around the right instep of the user.

The upper rigid member 702 is further configured for contacting a left knee of the user and the lower rigid member 704 is further configured for contacting a left instep of the user. As such, the therapeutic exercise may be performed by the user with the right knee and the right instep stabilized by the device or the left knee and left instep stabilized by the device.

Figure 7:
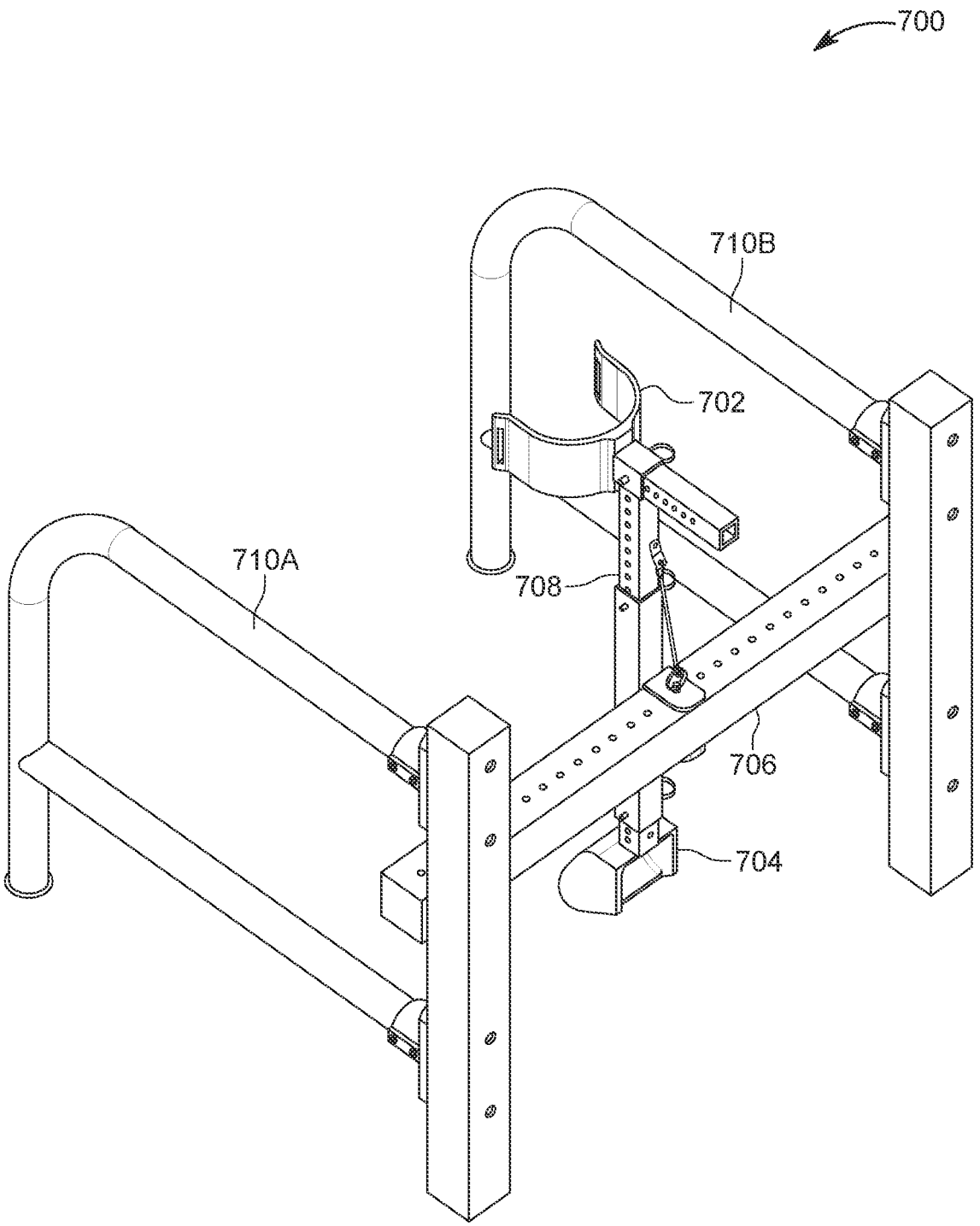
FIG. 7 depicts a diagram illustrating a downward angle three dimensional (3D) view of a second embodiment of a therapeutic stabilization device in accordance with embodiments of the present disclosure.

FIG. 7 illustrates a downward angle three-dimensional (3D) view of the therapeutic stabilization device 700.

Figure 8:
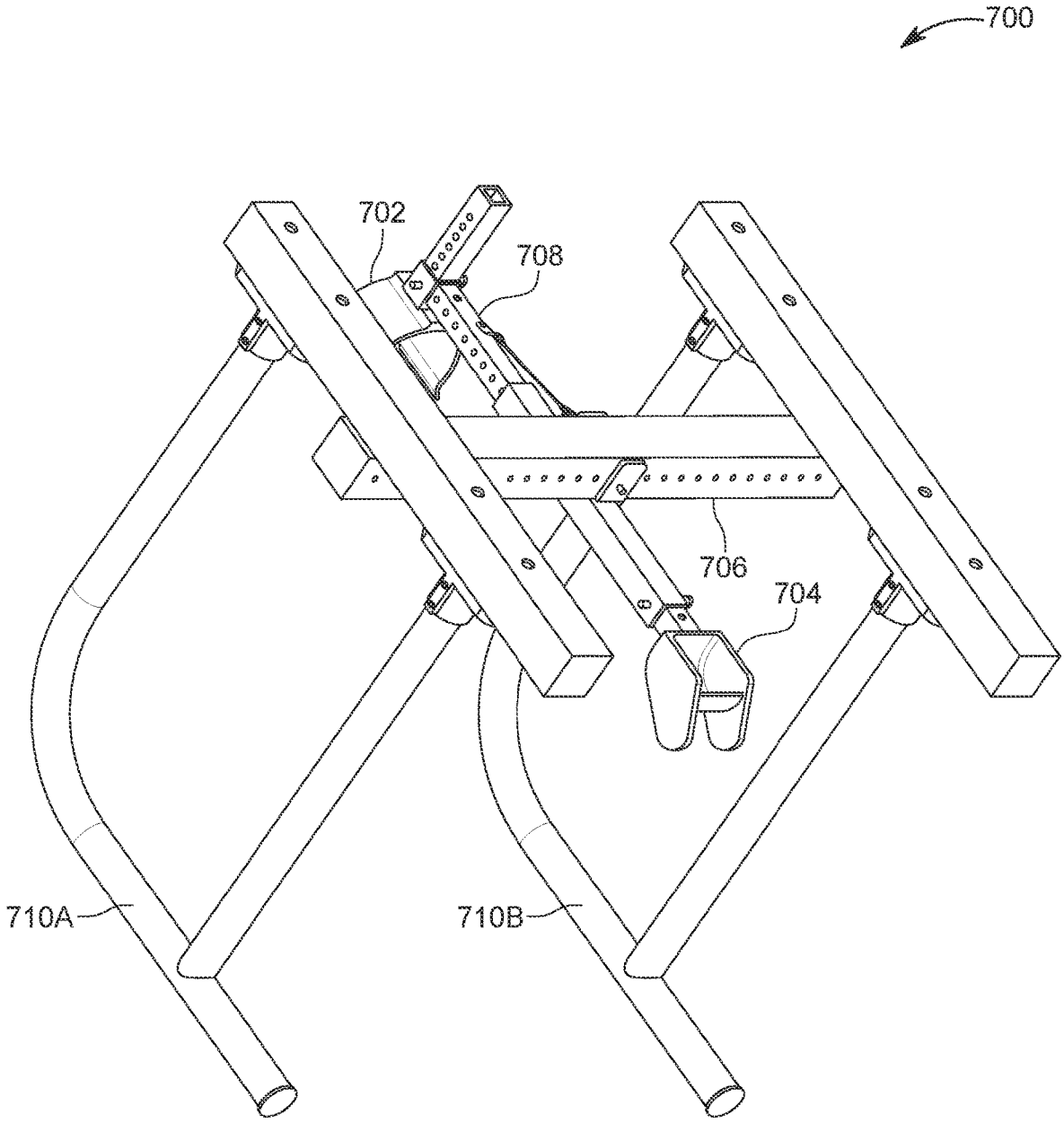
FIG. 8 depicts a diagram illustrating an upward 3D view of the second embodiment of the therapeutic stabilization device of FIG. 7 in accordance with embodiments of the present disclosure.

FIG. 8 illustrates an upward angle 3D view of the therapeutic stabilization device 700.

Figure 9:
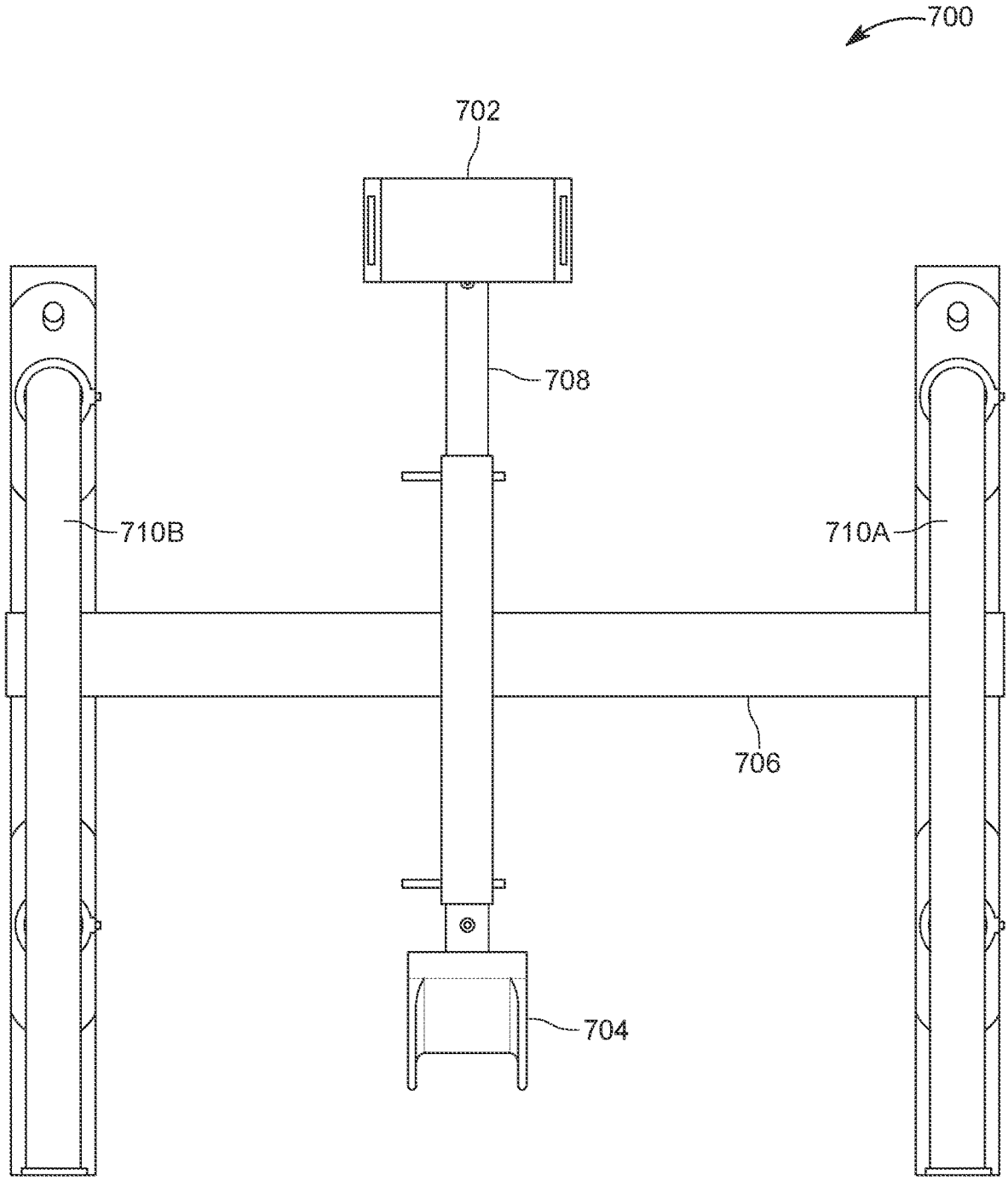
FIG. 9 depicts a diagram illustrating a front view of the second embodiment of the therapeutic stabilization device of FIG. 7 in accordance with embodiments of the present disclosure.

FIG. 9 illustrates a front view of the therapeutic stabilization device 700.

Figure 10:
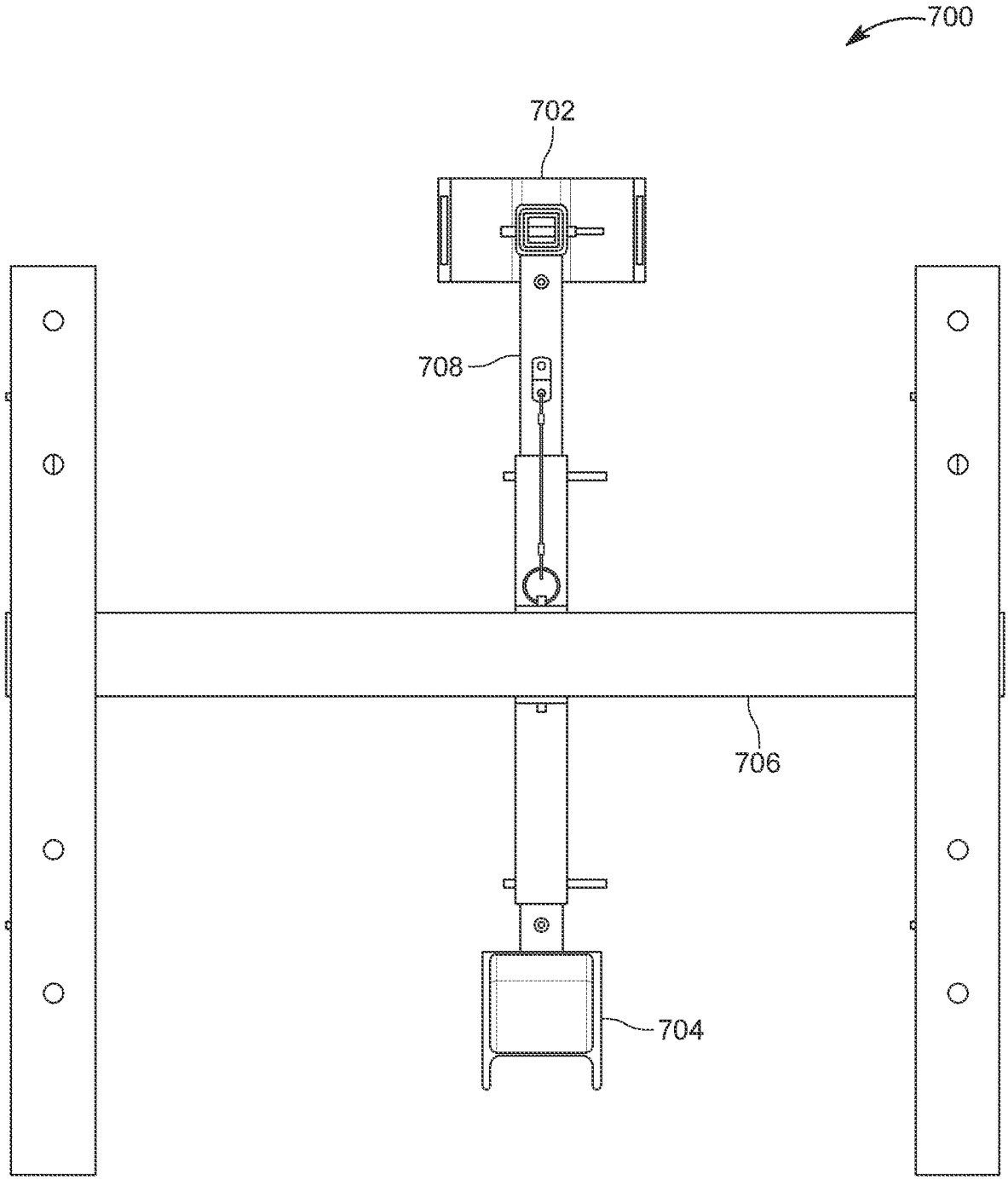
FIG. 10 depicts a diagram illustrating a rear view of the second embodiment of the therapeutic stabilization device of FIG. 7 in accordance with embodiments of the present disclosure.

FIG. 10 illustrates a rear view of the therapeutic stabilization device 700.

Figure 11:
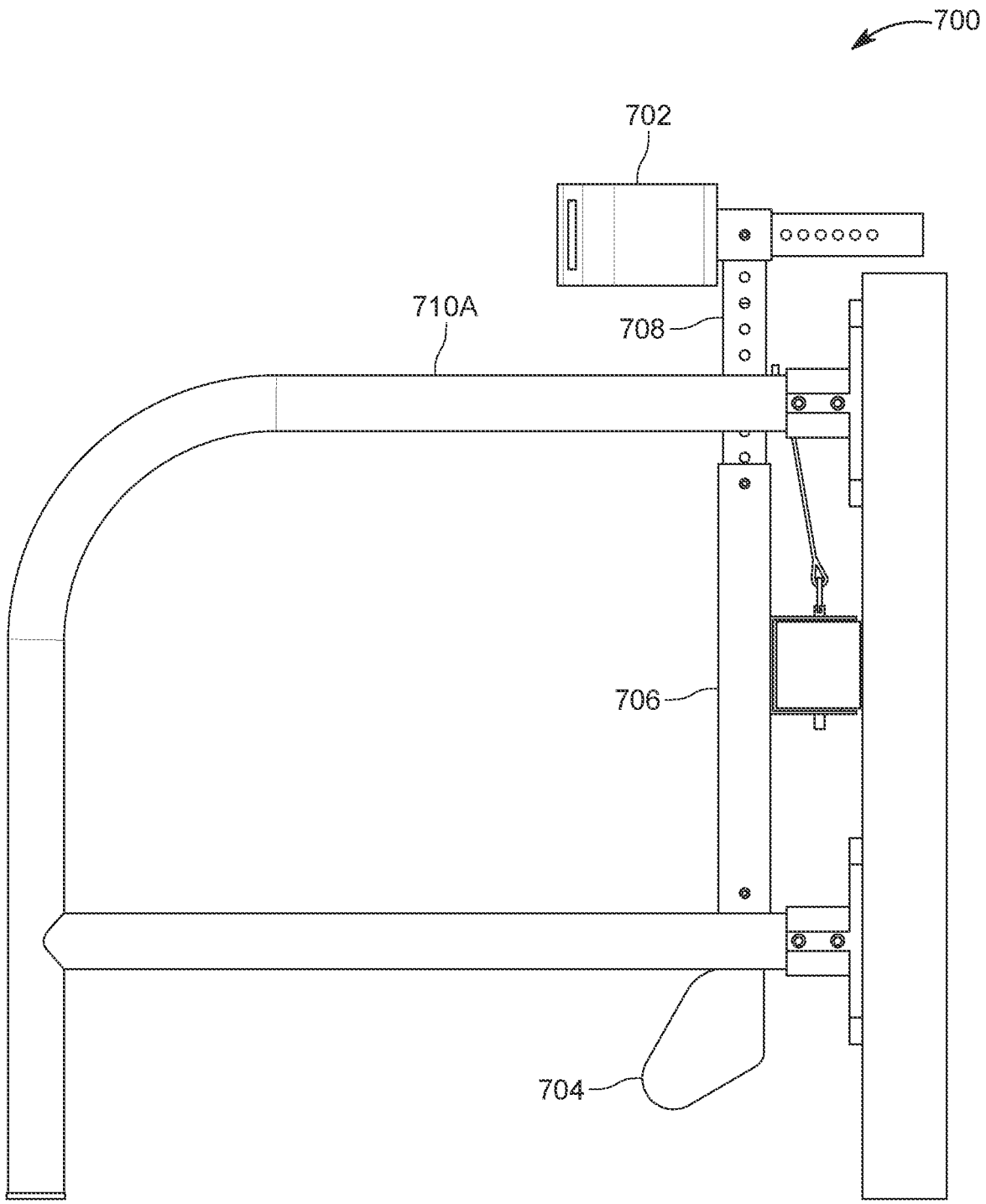
FIG. 11 depicts a diagram illustrating a right side view of the second embodiment of the therapeutic stabilization device of FIG. 7 in accordance with embodiments of the present disclosure.

FIG. 11 illustrates a right side view of the therapeutic stabilization device 700.

Figure 12:
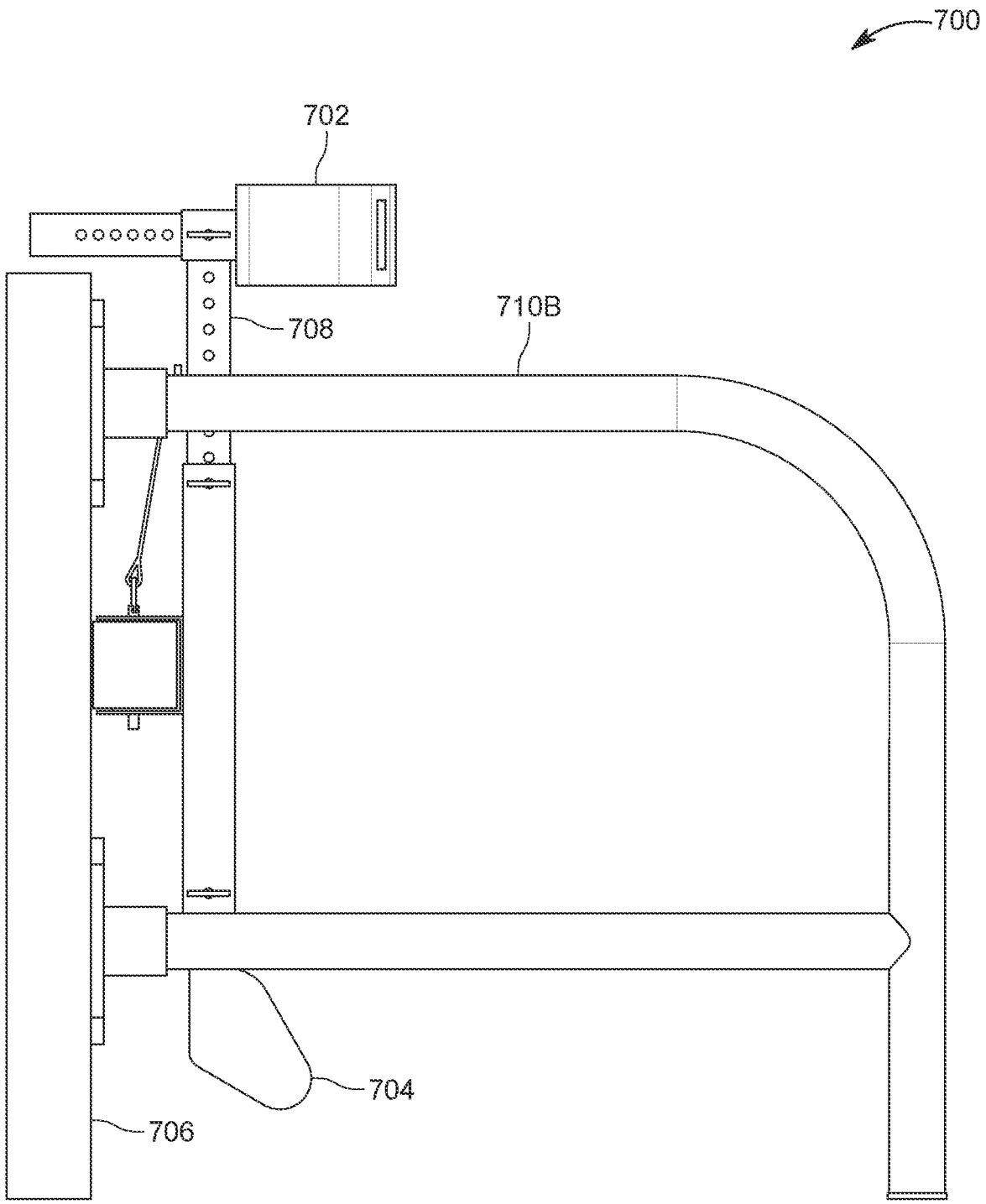
FIG. 12 depicts a diagram illustrating a left side view of the second embodiment of the therapeutic stabilization device of FIG. 7 in accordance with embodiments of the present disclosure.

FIG. 12 illustrates a left side view of the therapeutic stabilization device 700.

Figure 13:
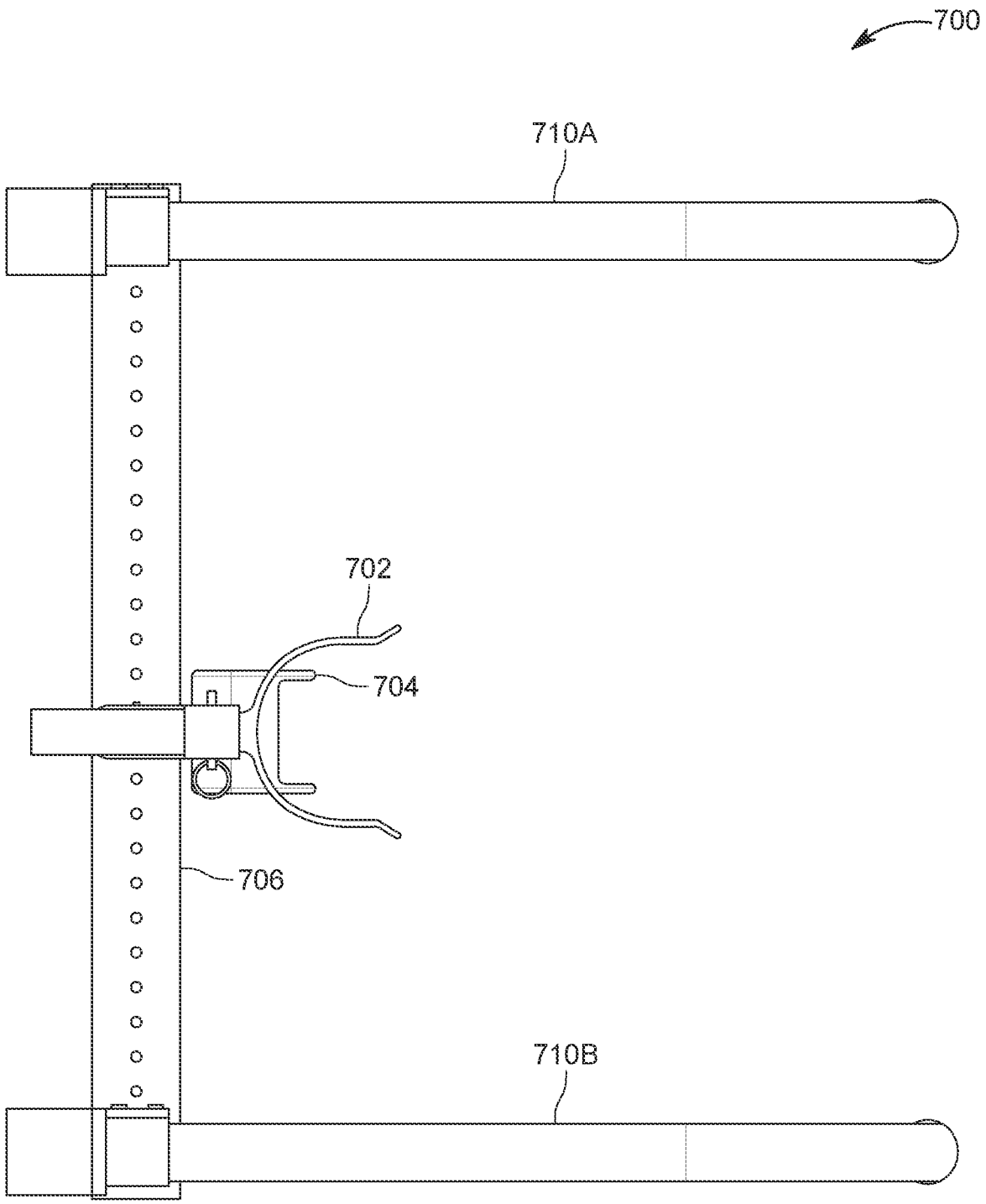
FIG. 13 depicts a diagram illustrating a top view of the second embodiment of the therapeutic stabilization device of FIG. 7 in accordance with embodiments of the present disclosure.

FIG. 13 illustrates a top view of the therapeutic stabilization device 700.

Figure 14:
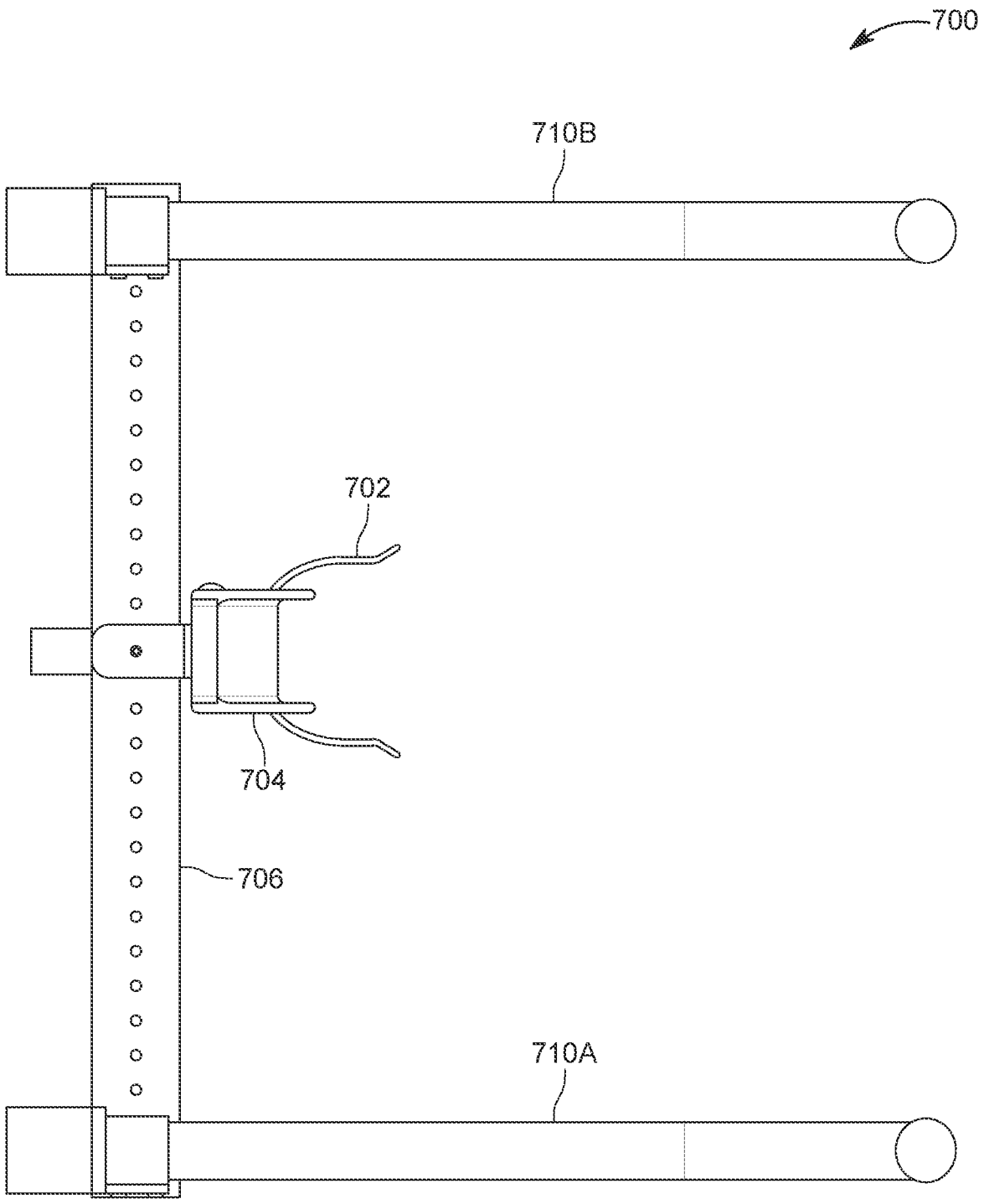
FIG. 14 depicts a diagram illustrating a bottom view of the second embodiment of the therapeutic stabilization device of FIG. 7 in accordance with embodiments of the present disclosure.

FIG. 14 illustrates a bottom view of the therapeutic stabilization device 700.

In another embodiment, a method of performing the therapeutic exercise using the therapeutic stabilization device 700 of FIG. 7 through FIG. 14 is disclosed. The method includes positioning a right knee of a user against an upper rigid member and positioning a right instep of the user against a lower rigid member. In some embodiments, the method may further include instructing the user to perform the therapeutic exercise. In other embodiments, the method may further include performing the therapeutic exercise by the user.

In another embodiment, a method of assembling the therapeutic stabilization device 700 is disclosed. The method includes connecting the upper rigid member 702 to the user adjustable vertical member of the stabilizing bracket 706 using the upper mechanical coupling 708. The method further includes connecting the lower rigid member 704 to the user adjustable vertical member of the stabilizing bracket 706 using the user adjustable lower mechanical coupling.

In another embodiment (not shown in FIG. 1 through FIG. 14), a lower leg attachment is disclosed for controlled and mediated structured lower limb counter weight rehab strengthening. This lower leg attachment helps to correct for the lack of understanding of the mechanics of proper squat technique. Specifically, the lower leg attachment is a stationary set ankle/knee stability device for proper squat mechanics. The lower leg attachment includes padded ankle locks for posterior hip activation when performing a squat. The lower leg attachment may be constructed from any desired semi-rigid material known or used in the art. Specifically, the lower leg attachment includes a top portion, a center portion, and a lower portion. The top portion includes a top rigid member forming a top outer surface; and a top soft member forming a top inner surface. The top inner surface is configured for contacting a knee of a first leg of a wearer. The center portion includes a center rigid member forming a center outer surface and a center soft member forming a center inner surface. The center inner surface is configured for contacting a shin of the first leg of the wearer. The lower portion includes a lower rigid member forming a lower outer surface and a lower soft member forming a lower inner surface. The lower inner surface is configured for contacting an instep of the first leg of the wearer.

Overall, the lower leg attachment provides a forward facing sheath housing for ankle/knee based movement in a flexible device targeting rehab enhancement of all lower limb muscular groups. The lower leg attachment allows the individual to establish motion for bio-mechanical success with knees that may otherwise be susceptible to injury. The lower leg attachment provides a mechanism utilizing guided steps for an adaptable environment to an injury free space, a worry free empowerment. The lower leg attachment may also reduce the pain an individual may feel when otherwise performing the exercise.

A squat motion begins with the posterior activation of the gluteal muscles mediated through the base of the spine linked through the hamstring facilitated through the knees anchoring the quadriceps and ultimately anchored by the ankle. Singular lunges may also be performed using the lower leg attachment. However the individual, physical therapist, and/or trainer must determine limitations. In certain circumstances, for example, the individual may have to work with a limited angle (e.g. 180 degrees to 135 degrees) if mobility is limited to nearly non-existent.

The lower leg attachment may be used singularly with one leg or two may be used with both legs. Additionally, the one and/or two lower leg attachments may be further stabilized to a base and/or a frame to provide additional support to the individual.

In another embodiment, a lower leg attachment for therapeutic exercise is disclosed. The lower leg attachment includes a top portion, a center portion, and a lower portion. The top portion includes a top rigid member forming a top outer surface; and a top soft member forming a top inner surface. The top inner surface is configured for contacting a knee of a first leg of a wearer. The center portion includes a center rigid member forming a center outer surface and a center soft member forming a center inner surface. The center inner surface is configured for contacting a shin of the first leg of the wearer. The lower portion includes a lower rigid member forming a lower outer surface and a lower soft member forming a lower inner surface. The lower inner surface is configured for contacting an instep of the first leg of the wearer.

In some embodiments, the top portion may be coupled in a rigid manner with the center portion and the center portion may be coupled in a rigid manner with the lower portion. In other embodiments, the top portion may be coupled in a semi-rigid manner with the center portion and the center portion may be coupled in a semi-rigid manner with the lower portion.

In some embodiments, the top portion may further include top flexible wings configured for securing the top inner surface to the knee. The lower portion may further include bottom flexible wings configured for securing the lower inner surface to the instep. The center portion may further include center flexible wings configured for securing the center inner surface to the shin.

In some embodiments, the lower leg attachment may further include a tubular elastic sleeve. The tubular elastic sleeve may be configured for surrounding both a calf and an ankle of the first leg of the wearer. The tubular elastic sleeve may be further configured for securing the top inner surface to the knee, securing the center inner surface to the shin, and securing the lower inner surface to the instep.

In some embodiments, the lower leg attachment may further include a first strap and a second strap, wherein the first strap and the second strap are configured for securing the lower leg attachment to the first leg of the wearer. The lower leg attachment of claim 8, wherein the first strap may be a first compression strap and the second strap may be a second compression strap. In certain embodiments, the first strap may be configured to wrap fully around the lower leg attachment and the second strap may also be configured to wrap fully around the lower leg attachment.

In some embodiments, the top portion may be configured to be semi-circumferential around the knee, the center portion may be configured to be semi-circumferential around the shin; and the lower portion may be configured to be semi-circumferential around the instep.

In some embodiments, the lower leg attachment may be configured for facilitating the wearer in performing a squat exercise, a lunge exercise, and/or the like.

In another embodiment, a method of performing a therapeutic exercise method is disclosed. The method includes installing a right lower leg attachment to a right leg of a wearer and installing a left lower leg attachment to a left leg of a wearer.

The right lower leg attachment includes a right top portion, a right center portion, and a right lower portion. The right top portion includes a right top rigid member forming a right top outer surface, and a right top soft member forming a right top inner surface. The right top inner surface is configured for contacting a right knee of a wearer. The right center portion includes a right center rigid member forming a right center outer surface and a right center soft member forming a right center inner surface. The right center inner surface is configured for contacting a right shin of the wearer. The right lower portion includes a right lower center rigid member forming a right lower outer surface and a right center soft member forming a right lower inner surface. The right lower inner surface is configured for contacting a right instep of the wearer.

The left lower leg attachment includes a left top portion, a left center portion, and a left lower portion. The left top portion includes a left top rigid member forming a left top outer surface and a left top soft member forming a left top inner surface. The left top inner surface is configured for contacting a left knee of a wearer. The left center portion includes a left center rigid member forming a left center outer surface and a left center soft member forming a left center inner surface. The left center inner surface is configured for contacting a left shin of the wearer. The left lower portion includes a left lower center rigid member forming a left lower outer surface and a left center soft member forming a left lower inner surface. The left lower inner surface is configured for contacting a left instep of the wearer.

In some embodiments, the method may further include performing a squat exercise, a lunge exercise, and/or the like. In other embodiments, the method may further include instructing the wearer to perform a squat exercise, a lunge exercise, and/or the like.

In some embodiments, the top portion may further include right top flexible wings configured for securing the right top inner surface to the right knee. The right lower portion may further include right bottom flexible wings configured for securing the right lower inner surface to the right instep. The right center portion may further include right center flexible wings configured for securing the right center inner surface to the right shin. The left top portion may further include left top flexible wings configured for securing the left top inner surface to the left knee. The left lower portion may further include left bottom flexible wings configured for securing the left lower inner surface to the left instep. The left center portion may further include left center flexible wings configured for securing the left center inner surface to the shin.

In summary, the lower leg attachment and associated methods disclosed herein provide a strategy to allow more motion. More motion provides more oxygen and results in more blood flow. As such more circulation achieves the goal of overall improving heart/lung function and clearing pathways within the vascular system.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. A device for facilitating a therapeutic exercise of a user, the device comprising:

a stabilizing bracket comprising:

a horizontal member;

a fixed position left side vertical member mechanically coupled at a left end of the horizontal member;

a fixed position right side vertical member mechanically coupled at a right end of the horizontal member; and a user adjustable vertical member configured to be mechanically coupled in a plurality of horizontal member locations between the fixed position left side vertical member and the fixed position right side vertical member;

an upper rigid member configured to be mechanically coupled with the user adjustable vertical member and further configured for contacting a right knee of the user;

a user adjustable upper mechanical coupling configured to be positioned between the upper rigid member and the user adjustable vertical member and further configured for providing a plurality of knee height positions for the upper rigid member; and a lower rigid member configured to be mechanically coupled with the user adjustable vertical member and further configured for contacting a right instep of the user, wherein the lower rigid member comprises a user adjustable lower mechanical coupling configured to mechanically couple with the user adjustable vertical member and further configured for providing a plurality of instep height positions for the lower rigid member.

2. The device of claim 1 further comprising:

a right side stabilizing leg configured to be mechanically coupled with the stabilizing bracket and further configured for contacting a horizontal surface; and a left side stabilizing leg configured to be mechanically coupled with the stabilizing bracket and further configured for contacting the horizontal surface.

3. The device of claim 2, wherein:

the fixed position left side vertical member is configured for contacting the horizontal surface; and the fixed position right side vertical member is configured for contacting the horizontal surface.

4. The device of claim 3, wherein the upper rigid member is configured to be user positioned in a plurality of horizontal locations relative to the lower rigid member.

5. The device of claim 4, wherein:

the horizontal member comprises a plurality of horizontal member holes; and the user adjustable vertical member is further configured to be mechanically coupled in the plurality of horizontal member locations between the fixed position left side vertical member and the fixed position right side vertical member using the plurality of horizontal member holes.

6. The device of claim 5, wherein:

the user adjustable upper mechanical coupling comprises a plurality of upper coupling holes; and the user adjustable upper mechanical coupling is further configured for providing the plurality of knee height positions for the upper rigid member using the plurality of upper coupling holes.

7. The device of claim 6, wherein:

the user adjustable lower mechanical coupling comprises a plurality of lower coupling holes; and the user adjustable lower mechanical coupling is further configured for providing the plurality of instep height positions for the lower rigid member using the plurality of lower coupling holes.

8. The device of claim 7, wherein:

the upper rigid member comprises a plurality of upper rigid member holes; and the upper rigid member is further configured to be user positioned in a plurality of horizontal knee locations relative to the lower rigid member using the plurality of upper rigid member holes.

9. The device of claim 8 further comprising:

a first locking pin configured for securing the user adjustable vertical member in the plurality of horizontal member locations between the fixed position left side vertical member and the fixed position right side vertical member using the plurality of horizontal member holes;

a second locking pin configured for securing the user adjustable upper mechanical coupling in the plurality of knee height positions for the upper rigid member using the plurality of upper coupling holes;

a third locking pin configured for securing the user adjustable lower mechanical coupling in the plurality of instep height positions for the lower rigid member using the plurality of lower coupling holes; and a fourth locking pin configured for securing the upper rigid member in the plurality of horizontal knee locations relative to the lower rigid member using the plurality of upper rigid member holes.

10. The device of claim 1 further comprising a first strap configured for securing the right knee of the user against the upper rigid member.

11. The device of claim 10 further comprising a second strap configured for securing the right instep of the user against the lower rigid member.

12. The device of claim 1, wherein:

the upper rigid member is further configured to be semi-circumferential around the right knee of the user; and the lower rigid member is further configured to be semi-circumferential around the right instep of the user.

13. The device of claim 1, wherein:

the upper rigid member is further configured for contacting a left knee of the user; and the lower rigid member is further configured for contacting a left instep of the user.

14. The device of claim 1 wherein the therapeutic exercise is a backward lunge exercise.

15. A method of performing a therapeutic exercise using a device comprising an upper rigid member and a lower rigid member, the method comprising:

positioning a right knee of a user against the upper rigid member; and positioning a right instep of the user against the lower rigid member, wherein the device further comprises:

a stabilizing bracket comprising:

a horizontal member;

a fixed position left side vertical member mechanically coupled at a left end of the horizontal member;

a fixed position right side vertical member mechanically coupled at a right end of the horizontal member; and a user adjustable vertical member configured to be mechanically coupled in a plurality of horizontal member locations between the fixed position left side vertical member and the fixed position right side vertical member; and a user adjustable upper mechanical coupling configured to be positioned between the upper rigid member and the user adjustable vertical member and further configured for providing a plurality of knee height positions for the upper rigid member, wherein:

the upper rigid member configured to be mechanically coupled with the user adjustable vertical member;

the lower rigid member configured to be mechanically coupled with the user adjustable vertical member; and the lower rigid member comprises a user adjustable lower mechanical coupling configured to mechanically couple with the user adjustable vertical member and further configured for providing a plurality of instep height positions for the lower rigid member.

16. The method of claim 15 further comprising instructing the user to perform the therapeutic exercise.

17. The method of claim 15 further comprising performing the therapeutic exercise by the user.

* * * * *